United States Patent [19]

English et al.

[11] Patent Number: 5,066,155

[45] Date of Patent: Nov. 19, 1991

[54] TOOTHBRUSH AND PASTE DISPENSER

[76] Inventors: Philip H. English, Box 1605, Avon, Colo. 81620; Anthony D. Szpak, 6215 Jamestown Dr., Parma, Ohio 44134

[21] Appl. No.: 456,721

[22] Filed: Dec. 26, 1989

Related U.S. Application Data

[63] Continuation-in-part of Ser. No. 237,184, Aug. 29, 1988, abandoned.

[51] Int. Cl.[5] ..... A46B 11/00; A46B 11/02

[52] U.S. Cl. ..... 401/175; 401/269

[58] Field of Search ..... 401/175, 194, 269

[56] References Cited

U.S. PATENT DOCUMENTS

| | | | |
|---|---|---|---|
| 1,170,744 | 2/1916 | Fesler | 401/194 X |
| 1,451,941 | 4/1923 | Clum | 401/175 |
| 1,726,197 | 8/1929 | Soukup | 401/175 |
| 1,944,067 | 1/1934 | Collins | 401/175 |
| 2,774,981 | 12/1956 | Bonilla | 401/175 |
| 3,868,188 | 2/1975 | Velardi | 401/175 X |
| 4,013,370 | 3/1977 | Gingras | 401/175 |
| 4,291,995 | 9/1981 | Dikoff | 401/175 |
| 4,622,984 | 11/1986 | Gaebel | 401/175 X |

FOREIGN PATENT DOCUMENTS

| | | | |
|---|---|---|---|
| 536637 | 4/1955 | Belgium | 401/175 |
| 76171 | 9/1946 | Czechoslovakia | 401/175 |
| 1028367 | 2/1953 | France | 401/175 |
| 699105 | 12/1965 | Italy | 401/175 |
| 278204 | 10/1927 | United Kingdom | 401/175 |

*Primary Examiner*—Steven A. Bratlie

*Attorney, Agent, or Firm*—Oldham & Oldham Co.

[57] ABSTRACT

A toothbrush and toothpaste dispenser unit comprising a brush head with a longitudinally extending toothpaste receiving and dispensing opening provided therein, and a disposable toothpaste receiver and dispenser cartridge which engages the brush head and connects to the opening in the brush head. A dispensing piston, and a drive screw are present with the cartridge while a drive member for the screw is present and it includes a one way rotary drive means. The cartridge has an outer sleeve which forms a handle for the dispenser unit. The unit has a single wall thickness, i.e. the outer sleeve of the cartridge, in the cartridge portion of the unit.

9 Claims, 4 Drawing Sheets

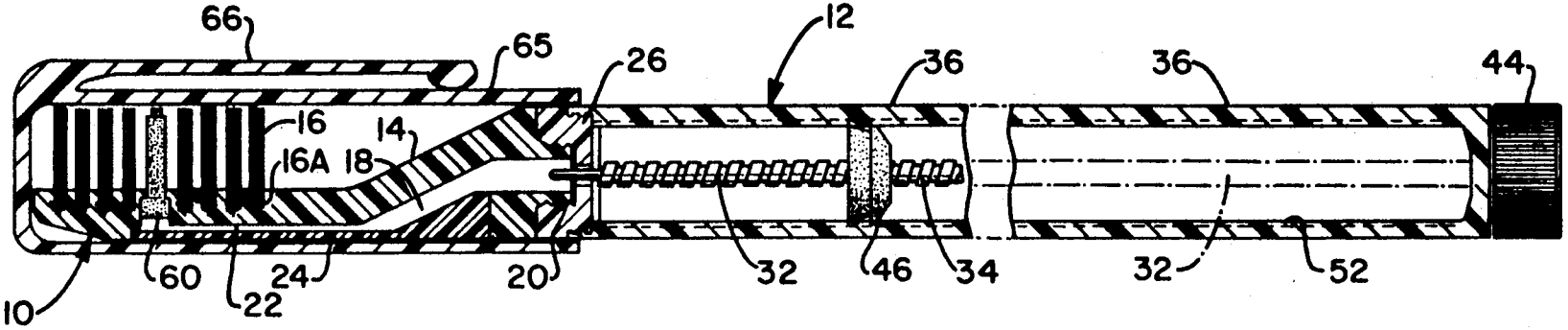
FIG.-1
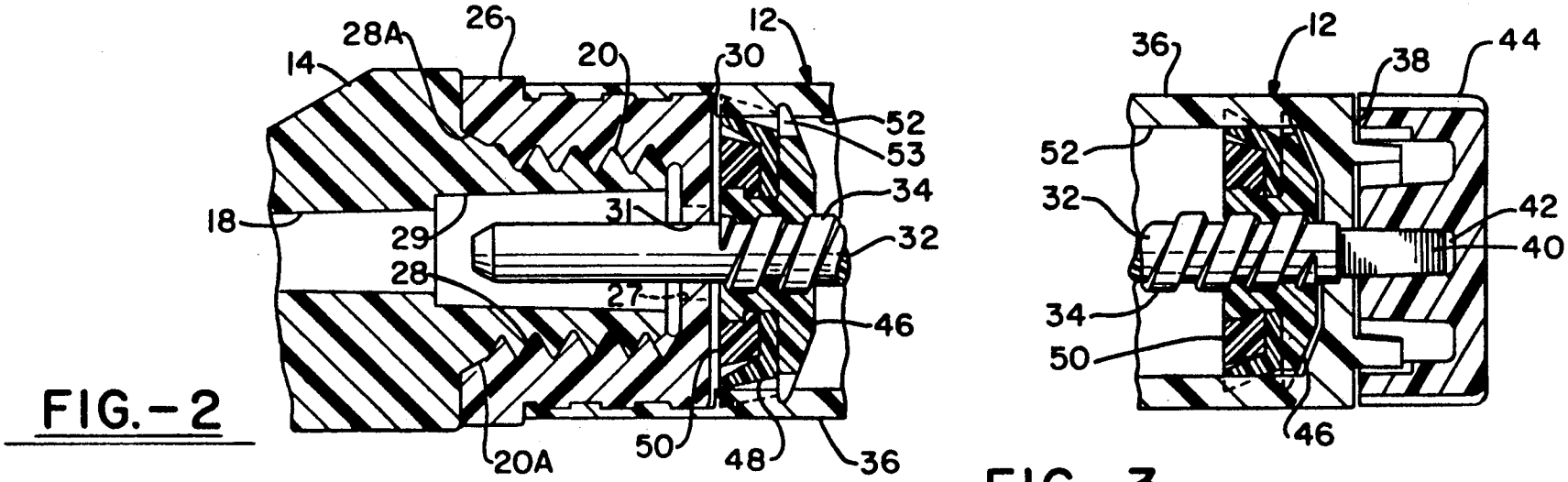
FIG.-2
FIG.-3

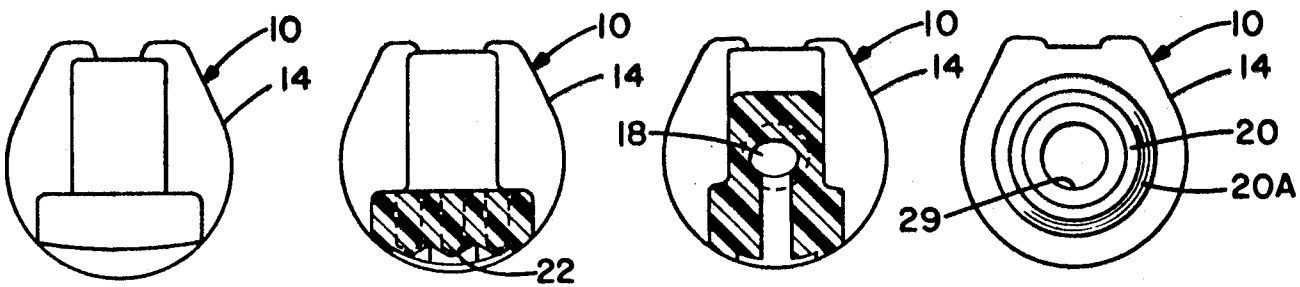
FIG.-6
FIG.-7
FIG.-8
FIG.-9
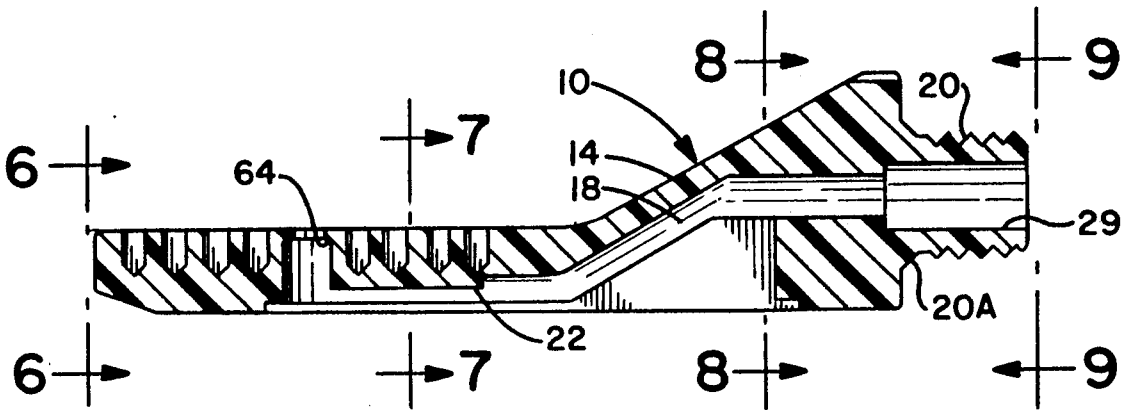
FIG.-4
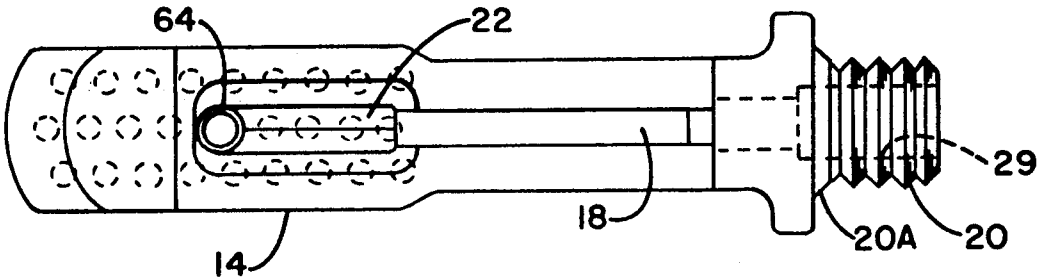
FIG.-5

TOOTHBRUSH AND PASTE DISPENSER

CROSS REFERENCE TO RELATED APPLICATION

This application is a continuation-in-part of our copending application, Ser. No. 237,184, filed Aug. 29, 1988, now abandoned.

TECHNICAL FIELD

This invention relates to a toothbrush and toothpaste dispenser unit having a toothbrush head and a disposable cartridge which contains toothpaste.

BACKGROUND OF THE INVENTION

Heretofore many efforts have been made to provide toothbrushes that have some type of integral toothpaste supply means associated therewith whereby one can provide a small amount of toothpaste for direct use in association with the brush. Usually the brush and toothpaste storage and dispenser means are formed into a compact unit and in some instances have been made with replaceable toothpaste carrier cartridges for use in association with a brush head.

Three categories of these types of products are:

1. Totally disposable toothbrushes wherein the entire product is disposed of after the toothpaste in the product is exhausted as is illustrated in prior art U.S. Pat. No. 4,521,128.

2. Refillable toothbrushes wherein the user refills the unit using a standard toothpaste tube as illustrated in prior art U.S. Pat. No. 4,332,497.

3. Disposable cartridge type toothbrushes where the toothpaste supply is replenished by discarding the spent cartridge and replacing it with a factory filled new cartridge as typically described in prior art U.S. Pat. No. 1,563,190.

Limited customer appeal of these products is evidence of deficiencies which may seem subtle but for a convenience item such as this are very significant factors. Examples of these deficiencies which greatly affect customer appeal are:

1. Toothbrushes that require the user to refill the product using a standard toothpaste tube. This requirement is highly inconvenient to the user and typically results in a mess requiring cleanup due to toothpaste leakage or resulting from the user handling components coated with toothpaste. This is illustrated in prior art U.S. Pat. No. 2,587,794.

2. Messy buildup of spent toothpaste that requires the user to clean the device when changing cartridges or refilling the device or simply accepting an unsanitary appearing condition. This type of problem is illustrated in prior art U.S. Pat. No. 1,451,941 wherein seepage around the threaded connection of the cartridge paste tube within its handle enclosure would cause the problem especially since the enclosing handle must be reused.

3. Absence of complete closure of the product including bristles results in a condition of wet bristles after use which is an undesirable condition especially when the user wishes to place it in a pocket or purse after use. This problem is illustrated in prior art U.S. Pat. No. 1,563,190.

4. Absence of high grade bristles of a stiffness and texture of typical toothbrushes. This type of product is illustrated in prior art U.S. Pat. No. 4,521,128.

5. Absence of sufficient toothpaste storage in the product to provide the user with a maximal number of brushings while maintaining a minimal product volume. This problem is illustrated in prior art U.S. Pat. No. 4,521,128 wherein the toothpaste is inefficiently utilized due to its expulsion at the base rather than near the top of the bristles and wherein a significant amount of unused toothpaste is trapped in the handle storage area.

6. Lack of providing a sufficient number of brushings to convey adequacy to the user. It is felt that a product of this type should provide 20 or more brushings.

The general object of the present invention is to provide a new and improved toothbrush with a self contained prefilled disposable and replaceable self contained paste storage section containing a controllable flow member for expelling toothpaste from the disposable portion to near the top of the bristles thereof and wherein when the product is not in use the bristle end is capped to form a sanitary compact pen-like appearance free from contamination of the users pocket or purse.

Another object of this invention is to provide minimum product size while maximizing the number of brushings provided by the cartridge by expelling the toothpaste near the top of the bristles and by utilizing an expulsion concept which effectively ejects a high percentage of the stored toothpaste to the bristle tops, by utilizing a disposable cartridge that acts both as the cartridge and whose outer shell For example, the toothbrush of this invention provides 30 brushings when each brushing uses 0.013. cubic inches of toothpaste. Use of the product has shown that this amount of toothpaste provides the user with ample toothpaste because it is deposited near the top of the bristles. While providing this large amount of brushings the total product volume is low and it is very compact. The outside diameter of the cartridge in a preferred embodiment is 0.52 inches and the total length of the disposable cartridge is 3.3 inches. The overall length of the product is 5.9 inches with the protective cap in place.

A further object of this invention is to provide a self contained prefilled and disposable toothbrush as described above but which provides the user with the option to discard the entire product after the toothpaste is spent.

Another object of this invention is to utilize toothpaste that does not readily dry and cause blockage of flow cavities and hence eliminates the need for the provision of cumbersome caps or plugs. A toothpaste of this type has a glycerin base, one current brand name of which is Colgate Winter Fresh Gel. Many typical toothpastes readily harden and render products having flow channels inoperative. This problem is described in prior art U.S. Pat. No. 4,332,497 which provides a complex plug stopper arrangement to minimize it.

Another object of the invention is to provide an improved paste dispenser system in a brush and toothpaste storage article and wherein the pressure piston in the apparatus can only be moved forwardly in the storage chamber and no retraction movement of the piston is possible. This feature prevents inadvertent reverse rotation of the piston screw which would allow air to be drawn into the toothpaste past the piston. Entrapped air would cause an objectionable weeping flow of toothpaste from the dispensing end after the product is used.

The foregoing and other objects and advantages of the present invention will be more apparent as the specification proceeds.

Reference now is made to the accompanying drawings, wherein:

FIG. 1 is a sectional view of the toothbrush and toothpaste dispenser and bristle cap of the unit of the invention;

FIG. 2 is a fragmentary vertical section through the connector end of the toothbrush head and the discharge end of the toothpaste storage dispenser;

FIG. 3 is a fragmentary vertical section through the dispenser control end of the toothpaste storage chamber or container;

FIG. 4 is an enlarged longitudinal section through the plastic frame for the brush head of the article of the invention;

FIG. 5 is a bottom plan of the article of FIG. 4;

FIG. 6 is an end elevation of the article of FIG. 4 taken on line 6—6 thereof;

FIG. 7 is a vertical section taken on line 7—7 of FIG. 4;

FIG. 8 is a vertical section taken on line 8—8 of FIG. 4;

FIG. 9 is a right side elevation taken on line 9—9 of FIG. 4;

When referring to corresponding members shown in the drawings corresponding numerals are used to facilitate comparison therebetween.

BEST MODE FOR CARRYING OUT THE INVENTION

Figure 10:
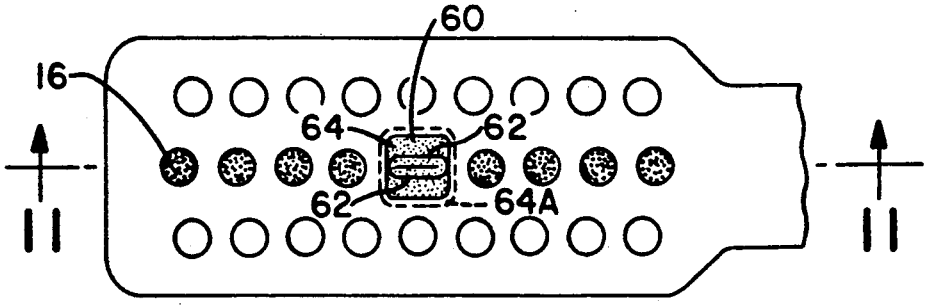
FIG. 10 is a top plan of the brush head of the article of the invention.
Figure 11:
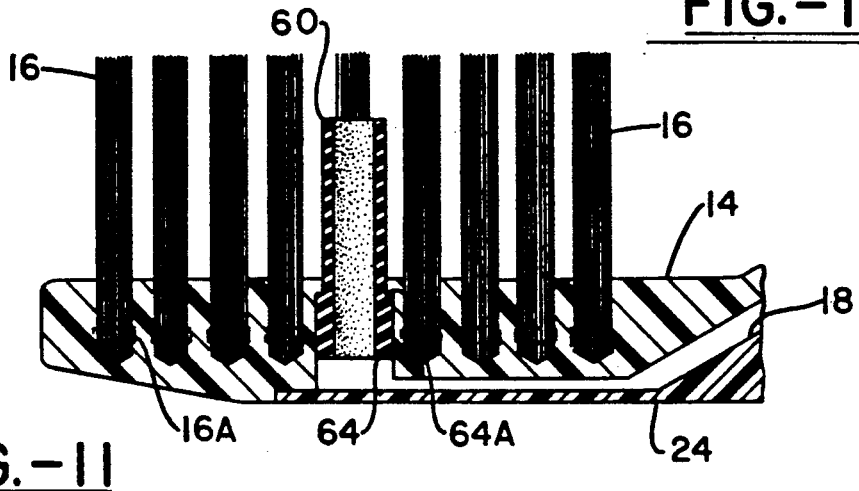
FIG. 11 is a fragmentary vertical section through the brush head of FIG. 10 as taken on line 11—11 thereof.
Figure 12:
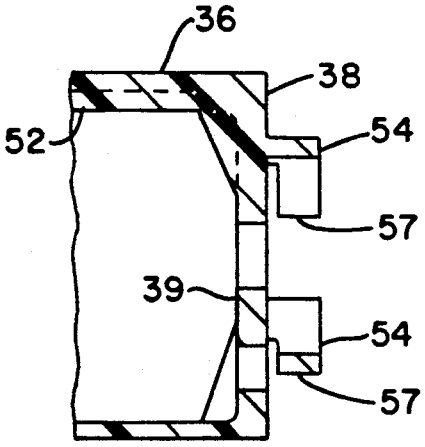
FIG. 12 is a fragmentary vertical section of the closed end of the toothpaste storage container.
Figure 13:
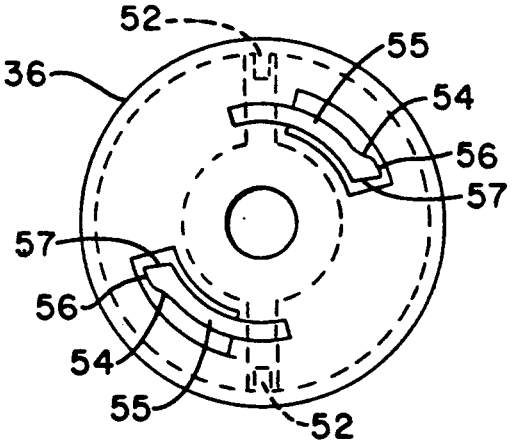
FIG. 13 is a right end elevation of the article of FIG. 12.
Figure 14:
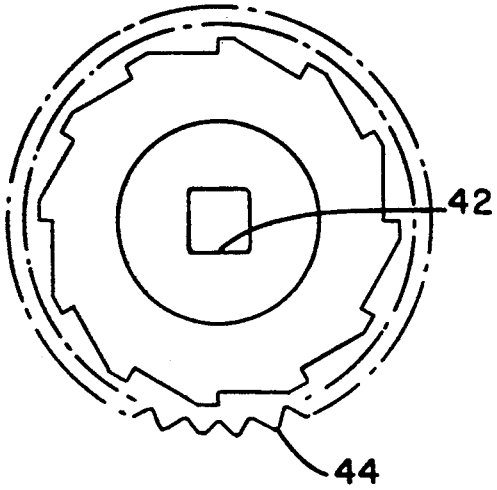
FIG. 14 is a left side view of the control disk for the toothpaste storage container.
Figure 15:
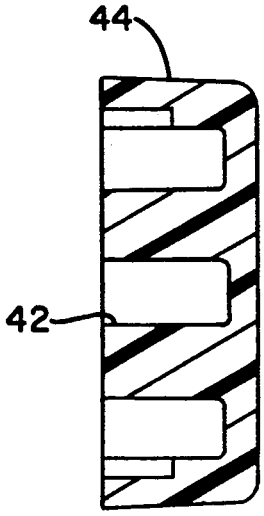
FIG. 15 is a vertical section through the control disk for end cap provided for the toothpaste storage container.

With reference to the details of the structure as is shown in the drawings, a brush head is indicated generally by the numeral 10. A prefilled disposable toothpaste receiver and dispenser cartridge, generally indicated as a whole by the numeral 12, is removably secured to toothbrush head 10. The brush head 10 and dispenser cartridge 12 form the forward (or anterior) and rear (or posterior) portions, respectively, of a toothbrush and toothpaste dispenser unit according to this invention. Brush head 10 and dispenser cartridge 12 are axially aligned.

The brush head 10 comprises, usually, a rigid molded body portion 14 that mounts a plurality of tufts of bristles 16 in conventional toothbrush groups therein, which groups are secured in place by wedges 16A. The brush head body 14 has a toothpaste dispenser passageway 18 formed therein. This passageway extends longitudinally from the discharge tube 60 through a tubular end portion of the body having threads 20 formed on the periphery thereof and conical sealing surface 20A. To complete this passageway 18, normally body 14 includes a recess indicated at 22 formed in a bottom portion of the body 14 but wherein a flat plate 24 made of plastic is secured over the recess to complete the passage way and simplify the molding of the body 14 of the brush head body.

The replaceable and disposable toothpaste receiver and dispensing cartridge 12 includes a plurality of parts, one being a forward end plug 26 that has a tapped bore 28 and conical sealing surface 28A therein which rotatably engages with the threads 20 on the toothbrush body to form a tight but removable engagement therewith. This bore in the end plug 26 has an end wall 30 with a hole 31 provided therein which hole snugly engages and rotatively mounts the end of drive shaft 32. The end plug 26 has circumferentially spaced discharge openings indicated at 27 for flow of the toothpaste from the interior of this cartridge unit 12 into a bore 29 of the brush head body and through support flow to the passageway 18 provided for the toothpaste for its dispensing action.

The drawings clearly show that the drive shaft 32 has an operating or controlled drive screw 34 provided thereon and extending the length thereof except for end portions of the drive shaft used for mounting the same in the unit of the invention.

This toothbrush disposable receiver and dispensing cartridge 12 includes a rigid outer sleeve 36 that is rotatably positioned and permanently fastened to the periphery of the end plug 26 and extends the majority of the length of the drive screw and drive shaft 32. This outer sleeve constitutes the sole wall thickness in the cartridge (or posterior) portion of the dispenser unit. A single wall thickness makes it possible to maximize cartridge capacity and get have an exterior diameter small enough for the unit to have a good "feel" to the user.

The outer sleeve 36 has a rear end wall 38 provided therein and it has a suitable opening therein through which the end of the drive shaft 32 protrudes. The drive shaft 32 has a square end 40 and this square end is received in a square hole 42 formed in an end cap, or disc 44 that engages the square end of the drive shaft for turning same to move the drive shaft in such a manner as to cause toothpaste to be expelled from the unit of the invention. This action is obtained by means of a piston 46 which operatively engages the drive screw portion of the drive shaft. This piston in turn may include a plastic or elastomeric piston cup 48 which is carried on the forward face of the piston 46 and suitably held in place thereon as by a filler plug 50 or by other means. The periphery of piston 46 or piston cup 48 is in sealing engagement with the inner surface of outer sleeve 36. Piston 46 may have a single piece (with no cup 48) if desired.

Rotation of the piston 46 with the drive screw 34 is prevented by means of a longitudinally extending rib 52 formed on the inner wall of the outer sleeve 36 and which in turn engages with a longitudinally extending slot 53 formed in the piston 46 and associated means whereby when the drive shaft is turned, the piston 46 will just move longitudinally within the outer sleeve 36 and will not rotate. Drive screw 34 turns or rotates in place and does not move longitudinally. The outer periphery of piston cup 48 is contoured to conform to the inner surfaces of the sleeve 36 so as to form a seal.

It should also be appreciated that the volume or space within the outer sleeve 36 extending up to the end plug 26 is filled with a suitable composition of a non-drying toothpaste for use with and discharge from the unit of the invention. A paste containing glycerin or other formulation that does not readily harden and clog passages is used in the invention. Toothpaste compositions containing water (especially those containing appreciable amounts of water) should be avoided because of their tendency to dry.

Replacement receiver and dispensing cartridges include a sealing closure means (not shown) such as a plug or tape which is removed and discarded by the user when he attaches it to the brush.

Preferably only forward movement of the piston 46 is permitted in the disposable cartridge dispensing unit of the invention. This is obtained by a one way rotary clutch drive action provided in the connection between the end cap 44, the outer sleeve 36, and the drive shaft 32. Thus the end wall 38 of the outer sleeve has a pair of flexibly positioned spring pawls 54 formed in diametrically opposed relation thereon. These pawls comprise an elongate mounting section 55 that terminates in a generally exceedingly enlarged head 56 having a radially extending end wall 57, that is flexibly supported by the plastic wall material forming the end wall 38 of outer sleeve 36 whereby the pawls are molded as a unit therewith. The end cap 44, in turn, is provided with a plurality of ratchet teeth 58 thereon which are adapted to engage with the heads 56 and walls 57 of the pawls and only allow the user to turn the end cap 44 in one direction, i.e. clockwise. Thus it does not permit any counter clockwise rotation of the drive shaft 32 and only forward movement of the piston 46 is permitted. Thus the piston will remain in full contact with any toothpaste contents received within the outer sleeve 36 and prevent any passage of air to this paste receiving bore area of the sleeve. One manually holds the outer sleeve 36 when turning end cap 44.

The paste, as it is forced from the cartridge and outer sleeve 36, will flow through bore 29 and the passageway 18 up into and through the brush head for discharge through a flexible and preferably elastomeric upright discharge tube 60 which is operably secured to the brush head, as by having an enlarged base 64 on this valve 60 engage with the shoulder areas 64A formed in the body 14 of the brush head. The toothpaste dispensing passageway 18 terminates immediately adjacent the base or opening for this discharge tube 60. Discharge tube 60 terminates in a typically flapper type valve 62 which has opposing lips thereof retained in the closed or sealed position all as indicated in FIG. 10 of the drawings. Valve 62, which forms the discharge opening of tube 60, is located near the lips of bristles 16 and well above the bottom portion of body 14. The valved end of discharge tube 60 is preferably flush with or slightly below the tips of bristles 16. However, when any expressive force is applied to the toothpaste, it will separate these lips and permit the toothpaste to flow out into the end areas of the brush tufts on the brush head.

A closure cap 65 with optional pocket clip 66 forms a cover for protecting the bristle end when the product is not in use. This cap gives the product the appearance of a typical fountain pen and, importantly, keeps the wet bristles from contaminating pocket or purse when it is stored in same.

The toothpaste used in the article of the invention is of a type which will not dry out and remain readily flowable over a long service life. A toothpaste using glycerin in its formulation has been found to meet this essential requirement.

In its preferred embodiment, the toothbrush unit of the invention provides the user with replaceable and disposable cartridges 12 while the brush head 10 and closure cap 65 are retained for continued use. This configuration readily permits the provision of bristles of the stiffness and quality of high quality typical toothbrushes at a reasonable total product life cost to the user. Further it allows the user to select and retain the particular bristle stiffness to suit his taste. Furthermore, this configuration does not convey a feeling of wastage that would occur if the entire product was disposable after the toothpaste was spent.

A second optional embodiment provides the user with a totally disposable product. After the toothpaste is spent, the user simply discards the entire unit. Since the product provides approximately 30 brushings, total discarding is a viable option. This is especially true when the product is used by persons while traveling or on vacation. The brush head body 14 and cartridge 12 may be formed as a single piece (e.g., by molding) in this embodiment.

Hence, by the present invention, an improved unit has been provided for the storage and dispensing of toothpaste in combination with a toothbrush and closure cap. The unit is made from simple available and/or moldable parts which can be readily engaged with each other.

The unit of the invention can be attractively molded from any desired materials and it provides a good functional compact toothpaste and toothbrush unit so as to meet the objects of the invention.

One embodiment of the invention is referred to in the specification but the scope of the invention is defined in the accompanying claims.

What is claimed is:

1. A toothbrush and toothpaste dispenser unit comprising:

a longitudinally extending brush head having bristles, a flexible upright discharge tube terminating near the tips of said bristles, and a longitudinally extending toothpaste receiving and dispensing opening provided therein whereby the opening forms a very shallow open recess along a substantial length of brush head;

a thin closure plate covering the open recess to define with the opening an elongated narrow channel extending a substantial length of the brush head;

a longitudinally extending disposable pre-filled toothpaste receiver and dispenser cartridge having a forward end and a back end, said cartridge at tis forward end engaging said brush head in a sealed relationship, said cartridge containing a toothpaste composed of a glycerin base which has very low thickening or hardening properties and including a rigid outer sleeve which forms a handle for and exterior wall of said unit, said outer sleeve constituting the sole wall thickness in the cartridge portion of said dispenser unit;

a dispensing piston having a radially outwardly flared resilient sealing lip resiliently and sealingly engaging the inner surface of said outer sleeve, said piston having an internally screw threaded opening for receiving a drive screw, an externally threaded drive screw for said piston, means to prevent rotation of said piston, and discharge opening means for permitting flow of toothpaste from said cartridge to said receiving and dispensing opening formed in said brush head;

a rotary drive means for said screw comprising an end cap at the back end of said cartridge for rotatably engaging an end of said screw; and

2. A toothbrush and toothpaste dispenser unit as in claim 1 including a longitudinally extending rib on the inner surface of said cartridge, said piston operably engaging said rib to be held against rotation thereby.

3. A toothbrush and toothpaste dispenser unit as in claim 1 wherein said rotary drive means is a one-way rotary drive means permitting only forward movement of said piston.

4. A toothbrush and toothpaste dispenser unit as in claim 3 wherein said cartridge has an end wall thereon, said one way rotary drive means comprises spring pawls formed on said end wall and ratchet teeth formed on said end cap to engage said spring pawls on one direction of rotary movement therebetween, said end cap being rotatably fixedly secured to said drive screw.

5. A toothbrush and toothpaste dispenser unit as in claim 1 wherein said drive screw rotates in place and rotation of said drive screw causes said piston to move longitudinally.

6. A toothbrush and toothpaste dispensing unit as in claim 1 where said discharge tube includes a flapper valve forming a connective flow channel in said dispensing opening to direct toothpaste to be deposited near to and on the top of the bristles.

7. A toothbrush and toothpaste dispensing unit as in claim 1 where said brush head is sealingly connected to said cartridge by a threaded connection passage and sealed by a continuous conical mating surface pair.

8. A toothbrush and toothpaste dispenser unit as in claim 1 wherein said brush head is reusable

9. A toothbrush and toothpaste dispenser unit as in claim 1, wherein the entire unit is disposable.

* * * * *